US006748892B1

(12) United States Patent
Rochfort

(10) Patent No.: US 6,748,892 B1
(45) Date of Patent: Jun. 15, 2004

(54) BARGE SYSTEM

(76) Inventor: William P. K. Rochfort, 105 Chula Brookfield Rd., Chula, GA (US) 31733-4343

( * ) Notice: Subject to any disclaimer, the term of this patent is extended or adjusted under 35 U.S.C. 154(b) by 37 days.

(21) Appl. No.: 10/094,737

(22) Filed: Mar. 11, 2002

(51) Int. Cl.[7] ..... B63B 35/44
(52) U.S. Cl. ..... 114/266
(58) Field of Search ..... 114/26, 266, 267, 114/125

(56) References Cited

U.S. PATENT DOCUMENTS 1,807,714 A * 6/1931 Taylor ..... 114/26
2,605,733 A * 8/1952 Smith
4,060,048 A * 11/1977 Breheret et al. ..... 114/266
4,928,616 A * 5/1990 Robishaw et al. ..... 114/267
5,911,542 A * 6/1999 Obrock et al. ..... 405/219

* cited by examiner

*Primary Examiner*—Ed Swinehart
(74) *Attorney, Agent, or Firm*—Edward P. Dutkiewicz

(57) ABSTRACT

A barge system comprises a barge. The barge is provided in a rectilinear configuration. Plates define an upper periphery and a lower periphery. Tubes are provided around the upper and lower peripheries. Provided next is a plurality of vertically disposed recesses formed in the side, front and rear plates. A plurality of connectors is provided. Each connector includes a post. Each connector has upper and lower ends. The lower ends have a downwardly facing inverted U-shaped member. A first portion is positioned upon a lower tube of one barge. A laterally disposed second portion is positioned upon an adjacent lower tube. An upwardly facing U-shaped member is provided with a first portion. The first portion is positioned to receive an upper tube of one barge. A laterally disposed second portion is provided. The second portion is positioned to receive an adjacent upper tube of an adjacent barge.

14 Claims, 13 Drawing Sheets

FIG 6A
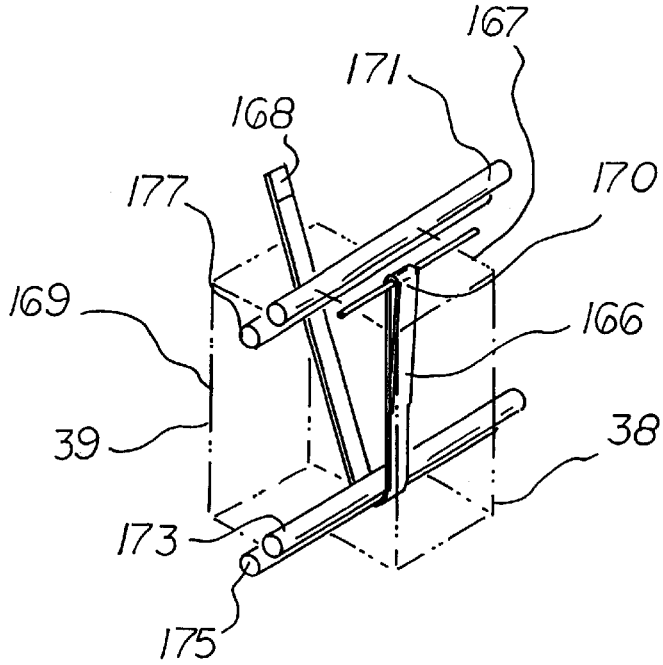
FIG 6B
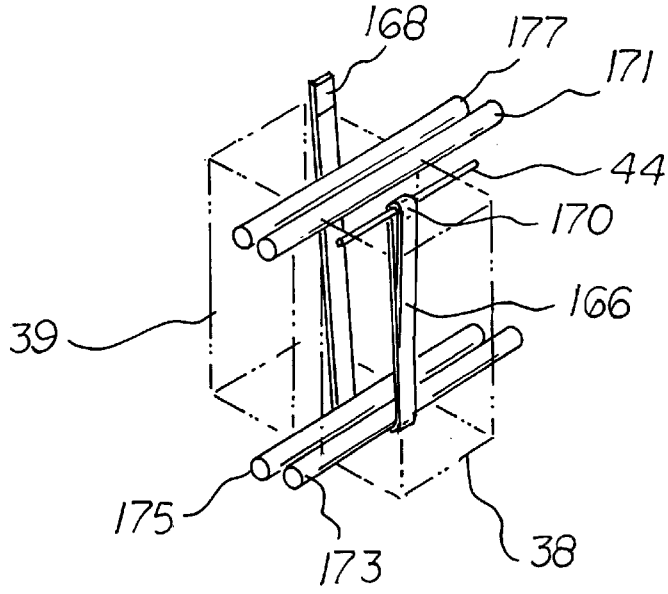
FIG 6

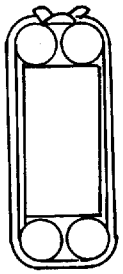
FIG 11D
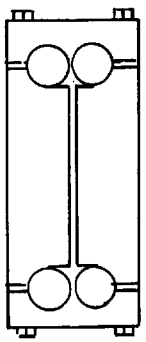
FIG 11B
FIG 11G
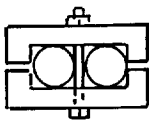
FIG 11A
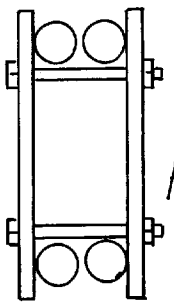
FIG 11
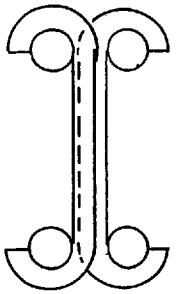
FIG 11F
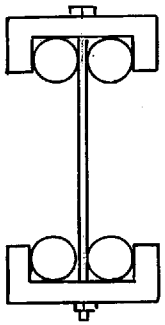
FIG 11C
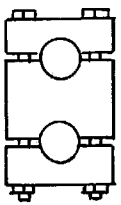
FIG 11E 1
2
3
4
5
6
7
8
9
10
11
12

BARGE SYSTEM

BACKGROUND OF THE INVENTION

1. Field of the Invention

The present invention relates to a truckable, water born barge system and more particularly pertains to safely securing and conveniently coupling together a plurality of barges that are able to be inverted by turning them over top for bottom.

2. Description of the Prior Art

The use of barges of known designs and configurations is known in the prior art. More specifically, barges of known designs and configurations previously devised and utilized for the purpose of coupling barges together through known methods and apparatuses are known to consist basically of familiar, expected, and obvious structural configurations, notwithstanding the myriad of designs encompassed by the crowded prior art which has been developed for the fulfillment of countless objectives and requirements.

In this respect, the barge system according to the present invention substantially departs from the conventional concepts and designs of the prior art, and in doing so provides an apparatus primarily developed for the purpose of safely securing and conveniently coupling together a plurality of barges.

Therefore, it can be appreciated that there exists a continuing need for a new and improved barge system which can be used for safely securing and conveniently coupling together a plurality of barges which are individually truckable to a job site which they may be conveniently and strongly connected to each other. In this regard, the present invention substantially fulfills this need.

SUMMARY OF THE INVENTION

In view of the foregoing disadvantages inherent in the known types of barges of known designs and configurations now present in the prior art, the present invention provides an improved barge system. As such, the general purpose of the present invention, which will be described subsequently in greater detail, is to provide a new and improved barge system and method which has all the advantages of the prior art and none of the disadvantages.

To attain this, the present invention essentially comprises a plurality of barges. Each barge is in a rectilinear configuration with rails at the corner intersections. Each barge has a horizontal rectangular upper plate and a parallel lower plate. The horizontal plates have long parallel side edges and short parallel front and rear edges which are joined to continuous tubes at each intersection. Each barge also has a pair of vertical parallel side plates and vertical parallel front and rear plates. The vertical plates have the upper edges coupled to the tubes that surround the upper plate. In this manner an upper periphery is defined. The vertical plates have lower edges. The lower edges are coupled to the continuous tubes that are coupled to the edges of the lower plate. In this manner a lower periphery is defined. Cylindrical tubes are provided. The tubes are in a continuous rectangular configuration around the entire upper periphery and around the entire lower periphery. A plurality of vertically disposed recesses are provided. The recesses are formed in the vertical plates and the upper and lower plates. The recesses constitute pockets inwardly of the tubes. The recesses all have a common height equal to the height of the barge. The recesses also all have a common axial length and a common lateral width. Provided next is a plurality of connectors. Each connector includes a rectilinear vertical post. The vertical post is positionable in adjacent recesses of adjacent barges to be coupled between upper and lower tubes. Each connector has an upper end and a lower end. The lower end has a downwardly facing inverted U-shaped member. A first arcuate portion is provided. The first arcuate portion is positioned upon a lower tube of one barge. A laterally disposed second arcuate portion is provided. The second arcuate portion is positioned upon an adjacent lower tube of an adjacent barge for coupling the barges. An upwardly facing uninverted U-shaped member. A first arcuate portion is provided. The first arcuate portion is positioned to receive an upper tube of one barge. A laterally disposed second arcuate portion is provided. The second arcuate portion is positioned to receive an adjacent upper tube of an adjacent barge for coupling the barges. The uninverted U-shaped member has a depending three sided skirt. The skirt is adapted to be slid over the upper extent of the vertical post during the coupling of barges. Also provided is a wedge. The wedge is positioned within a recess between adjacent upper and lower tubes. The wedge is in contact with one end of the connector. In this manner axial displacement of the connector along the tubes is precluded. A second configuration of the system shows an alternative wedging type connector for an even more rigid connection that may be preferred for some applications. This system is self tightening due to the fall of an upper wedge if when space becomes available. Both of these systems are easily put in place and just as importantly easy to remove after extended periods in hostile environments (salt water, etc.) as the components easily remove by reversing the placement operation. Further provided is a plurality of towing or attaching links. Each link has a linear central region. Each link has opposed C-shaped ends. The first end is adapted to be positioned over a tube of one barge in a recess. The second end is adapted to be positioned over a tube of an adjacent barge or other water born vessel in an adjacent recess of an adjacent barge or other water born vessel for coupling the front of one barge or other vessel to the back of another barge or other water born vessel to be towed. A filler member is provided. The filler member is positioned in each link between the ends. In this manner the space between the ends of the links is filled. Supplemental retaining wedges are provided for holding the links in place during assembly and others during operation. In this manner axial shifting of the links during towing is precluded. Even further provided are tubes with attached plates. The plates and tubes are positioned on the upper and lower sides of adjacent existing barges. The plates and tubes create spaces between adjacent barges for the use of the coupling devices. Provided last is a flexible leveling strap. The strap has a first free end and a second fixed end secured adjacent to the upper surface of a barge adjacent to a recess. The strap extends downwardly between a recess and one upper tube and then a lower tube. The strap then extends upwardly between an adjacent recess and an adjacent lower tube and then an adjacent upper tube. The first free end is adapted to be lifted to raise the adjacent lower ends, and hence the barge, to a common level.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved barge system which has all of the advantages of the prior art barges of known designs and configurations and none of the disadvantages.

It is another object of the present invention to provide a new and improved barge system which may be easily and efficiently manufactured and marketed.

It is further an object of the present invention to provide a new and improved barge system which is of durable and reliable constructions.

An even further object of the present invention is to provide a new and improved barge system which is susceptible of a low cost of manufacture with regard to both materials and labor, and which accordingly is then susceptible of low prices of sale to the consuming public, thereby making such barge system economically available to the buying public.

Even still another object of the present invention is to provide a barge system for safely securing and conveniently coupling together a plurality of barges.

It is a further object of the barge configuration to allow for easy road transportation of each unit.

Lastly, it is an object of the present invention to provide a new and improved barge system comprising a barge. The barge is provided in a rectilinear configuration. Plates define an upper periphery and a lower periphery. Tubes are provided around the upper and lower peripheries. Provided next is a plurality of vertically disposed recesses formed in the side, front and rear plates. A plurality of connectors is provided. Each connector includes a post. Each connector has an upper and lower ends. The lower ends have a downwardly facing inverted U-shaped member. A first portion is positioned upon a lower tube of one barge. A laterally disposed second portion is positioned upon an adjacent lower tube. An upwardly facing U-shaped member is provided with a first portion. The first portion is positioned to receive an upper tube of one barge. A laterally disposed second portion is provided. The second portion is positioned to receive an adjacent upper tube of an adjacent barge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 6A and 6B are perspective illustrations of the barge leveling system

FIGS. 11A, 11B, 11C, 11D, 11E, 11F and 11G are various connections as a with the present invention.

The same reference numerals refer to the same parts throughout the various Figures.

DESCRIPTION OF THE PREFERRED EMBODIMENT

Figure 1:
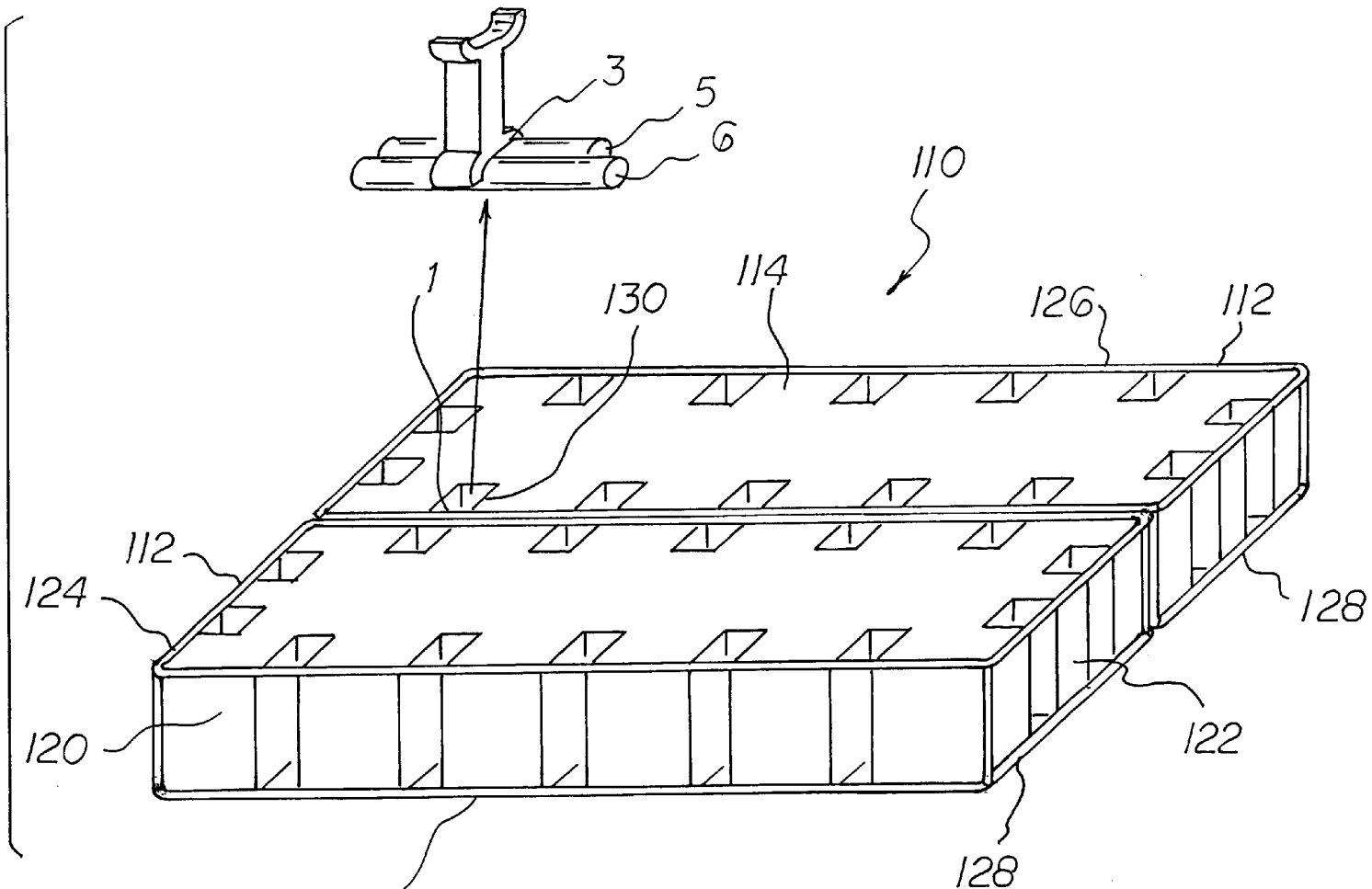
FIG. 1 is a perspective illustration of a barge system constructed in accordance with the principles of the present invention.

With reference now to the drawings, and in particular to FIG. 1 thereof, the preferred embodiment of the new and improved barge system embodying the principles and concepts of the present invention will be described.

The present invention, the barge system 110 is comprised of a plurality of components. Such components in their broadest context include a barge, tubes, a plurality of vertically disposed recesses, and a plurality of connectors. Such components are individually configured and correlated with respect to each other so as to attain the desired objective.

As shown in FIG. 1, first provided is a plurality of barges 112. Each barge is provided in a rectilinear configuration. Each barge has a horizontal rectangular upper plate 114 and a parallel lower plate 116. The horizontal plates have long parallel side edges and short parallel front and rear edges. Each barge also has a pair of vertical parallel side plates 120 and vertical parallel front and rear plates 122, 124. The vertical plates have upper edges coupled to the tubes 126 that are attached to the upper plate. In this manner an upper periphery is defined. The vertical plates have lower edges.

The lower edges are coupled to tubes 128 that are attached to the edges of the lower plate. In this manner a lower periphery is defined.

Cylindrical tubes 126, 128 are provided. The tubes are provided in a rectangular configuration around the entire upper periphery and around the entire lower periphery. The tubes are preferably configured with a circular configuration but it should be realized that any cross sectional configuration or periphery strengthening could be utilized. Further, the addition of the peripheral tubes at the upper and lower peripheries allows for increased rigidity of the barge. Further the design of tubes and connectors extends the life of the barge since it could be inverted for continued usage as the portion of the barge in the water will usually deteriorate long before the portion above the waterline.

A plurality of vertically disposed recesses 130 are provided. The recesses are formed in the vertical plates and the upper and lower plates. The recesses constitute pockets inwardly of the tubes. The recesses all have a common height equal to the height of the barge.

Figure 2:
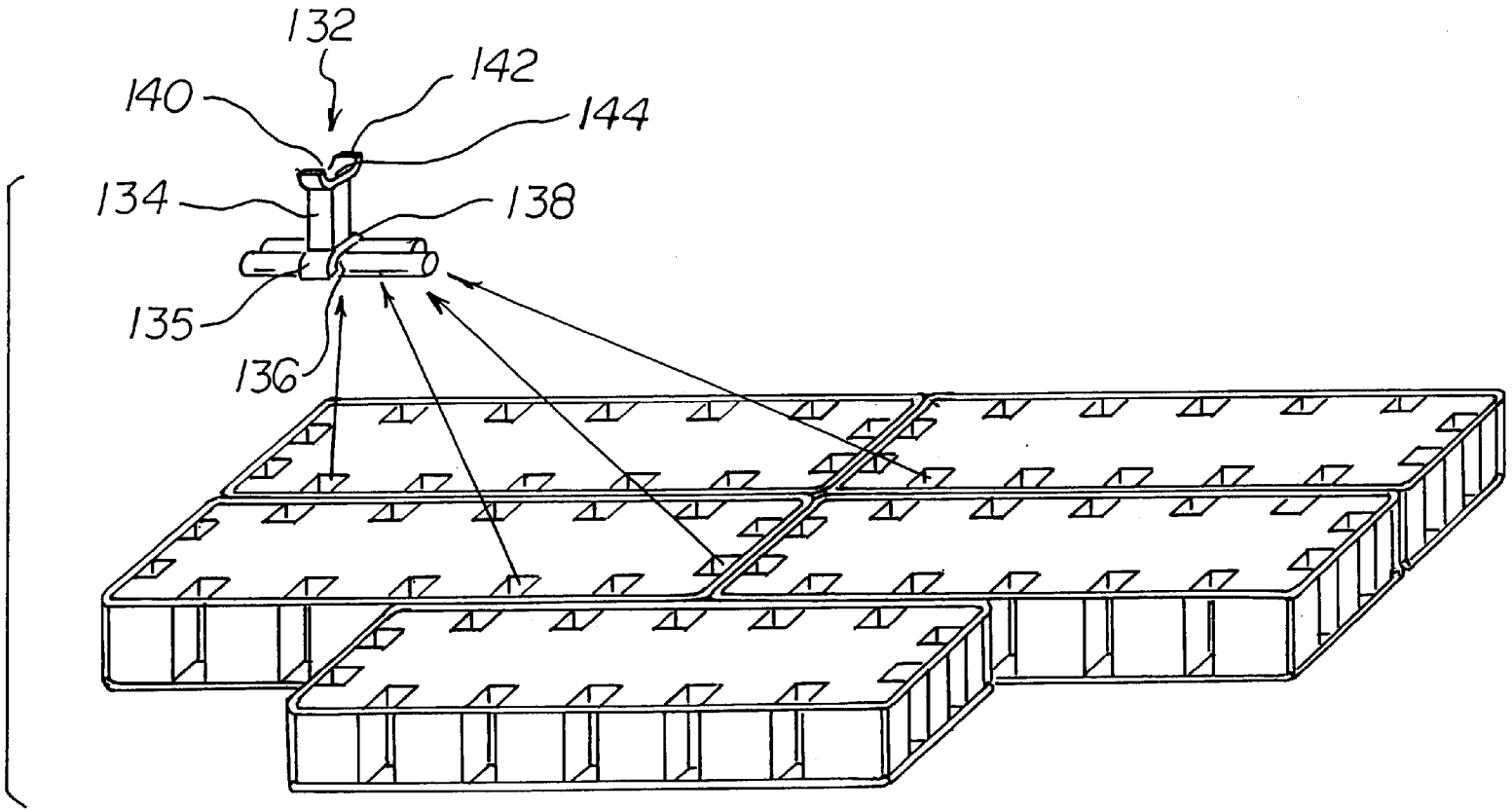
FIG. 2 is an enlarged perspective illustration of a plurality of barges coupled connectors.
Figure 3:
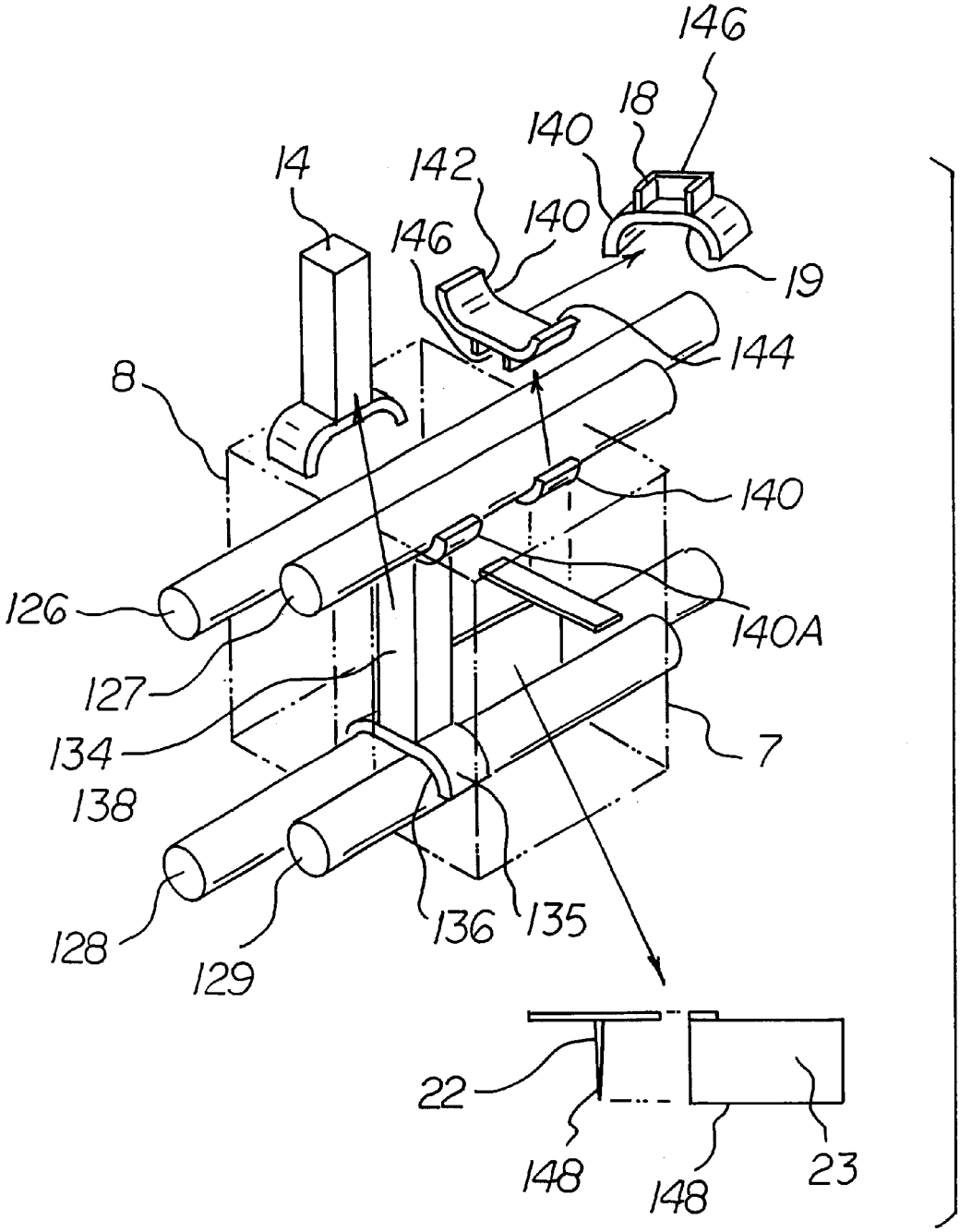
FIG. 3 is a enlarged perspective illustration swing details of the connector system.

As shown in FIG. 2, provided next is a plurality of connectors 132. Each connector includes a rectilinear vertical post 134. The vertical post is positionable in adjacent recesses of adjacent barges to be coupled between upper and lower tubes. Each connector has an upper end and a lower end. The lower end has a downwardly facing inverted U-shaped member 135. A first arcuate portion 136 is provided. The first arcuate portion is positioned upon a lower tube of one barge. A laterally disposed second arcuate portion 138 is provided. The second arcuate portion is positioned upon an adjacent lower tube of an adjacent barge for coupling the barges. An upwardly facing uninverted U-shaped member 140. A first arcuate portion 142 is provided. The first arcuate portion is positioned to receive an upper tube of one barge. A laterally disposed second arcuate portion 144 is provided. The second arcuate portion is positioned to receive an adjacent upper tube of an adjacent barge for coupling the barges. The uninverted U-shaped member has a depending three sided skirt 146 as shown in FIG. 3. The skirt is adapted to be slid over the upper extent of the vertical post during the coupling of barges.

The recesses or pockets could be any desired size for any particular application. For example, if enlarged, the pockets could support spuds, vertical poles coupling a barge to the bed of the river or other body of water to retain the position of the barge.

Also provided is a wedge 148. The wedge is positioned within a recess between adjacent lower tubes. A similar wedge not shown is placed between upper tubes. A similar wedge, not shown, is placed between upper tubes. Each wedge is in contact with one end of the connector and the side of the pockets at the other end by its T bar. In this manner axial displacement of the connector along the tubes is precluded.

The axial length of the connector ends is slightly less than the width of the pockets while the width of the connector ends is slightly less than the length of the pockets. In this manner, the lower end of a connector may readily be slid down a pocket then turned 90 degrees for proper positioning for operation. Thereafter the top connector end may be laterally slid into position to complete the coupling between a connector and the tubes.

Figure 5:
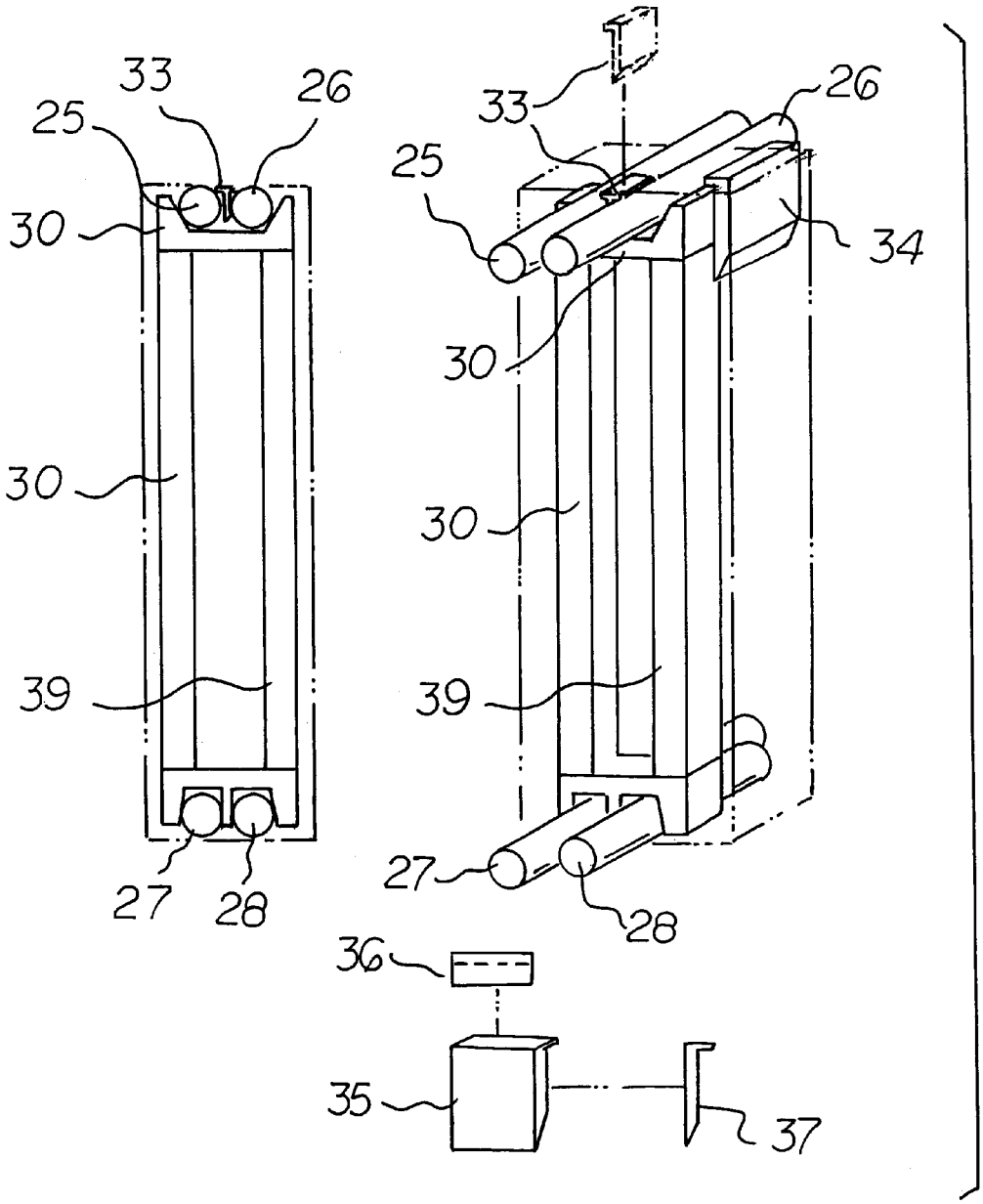
FIG. 5 is a enlarged perspective illustrations of an alternative connector associated with the present invention.

FIG. 5 shows an alternative connector with two rectilinear vertical posts 30 and 39 welded to the bottom connector. The lower end 29 has a downwardly facing spaced member with tapered sides. The one side of the E-shaped connector is positioned upon a lower tube of one barge. A laterally disposed second side is provided. The second side is positioned upon an adjacent lower tube of an adjacent barge for coupling the barges in a tight wedged configuration. An upwardly facing U-shaped connector member 30 is shown. A first portion of the connector is positioned to receive an upper tube of one barge. A laterally disposed second portion receives the rail of an adjacent barge for further coupling the barges after coupling. The spacer wedge 34 is put in place to stop displacement of parts and prevent longitudinal movement of barges.

Figure 7:
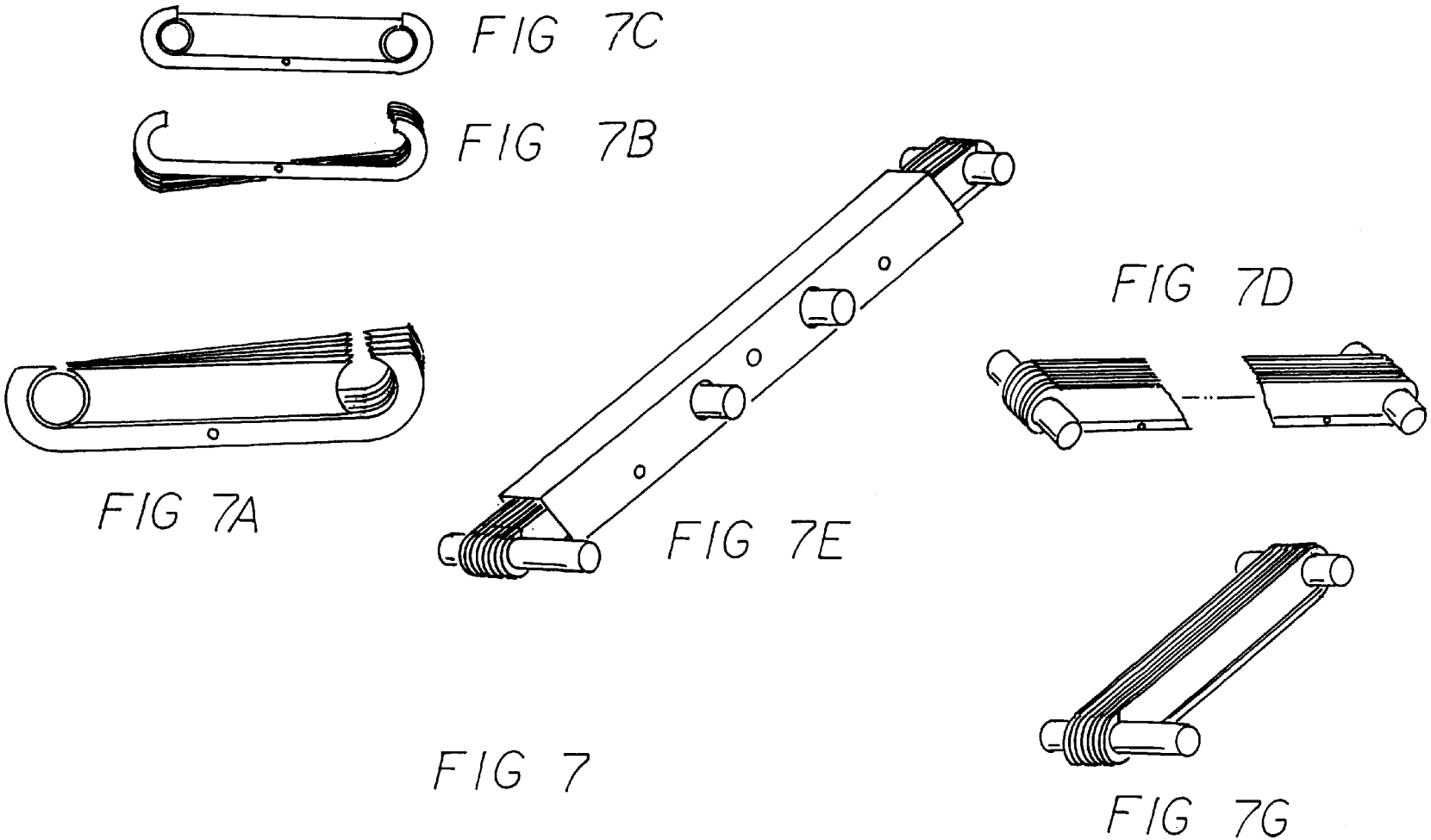
FIGS. 7A, 7B, 7C, 7D, 7E, 7F, and 7G are an exploded views of the multi-plate flexible connectors.
Figure 8:
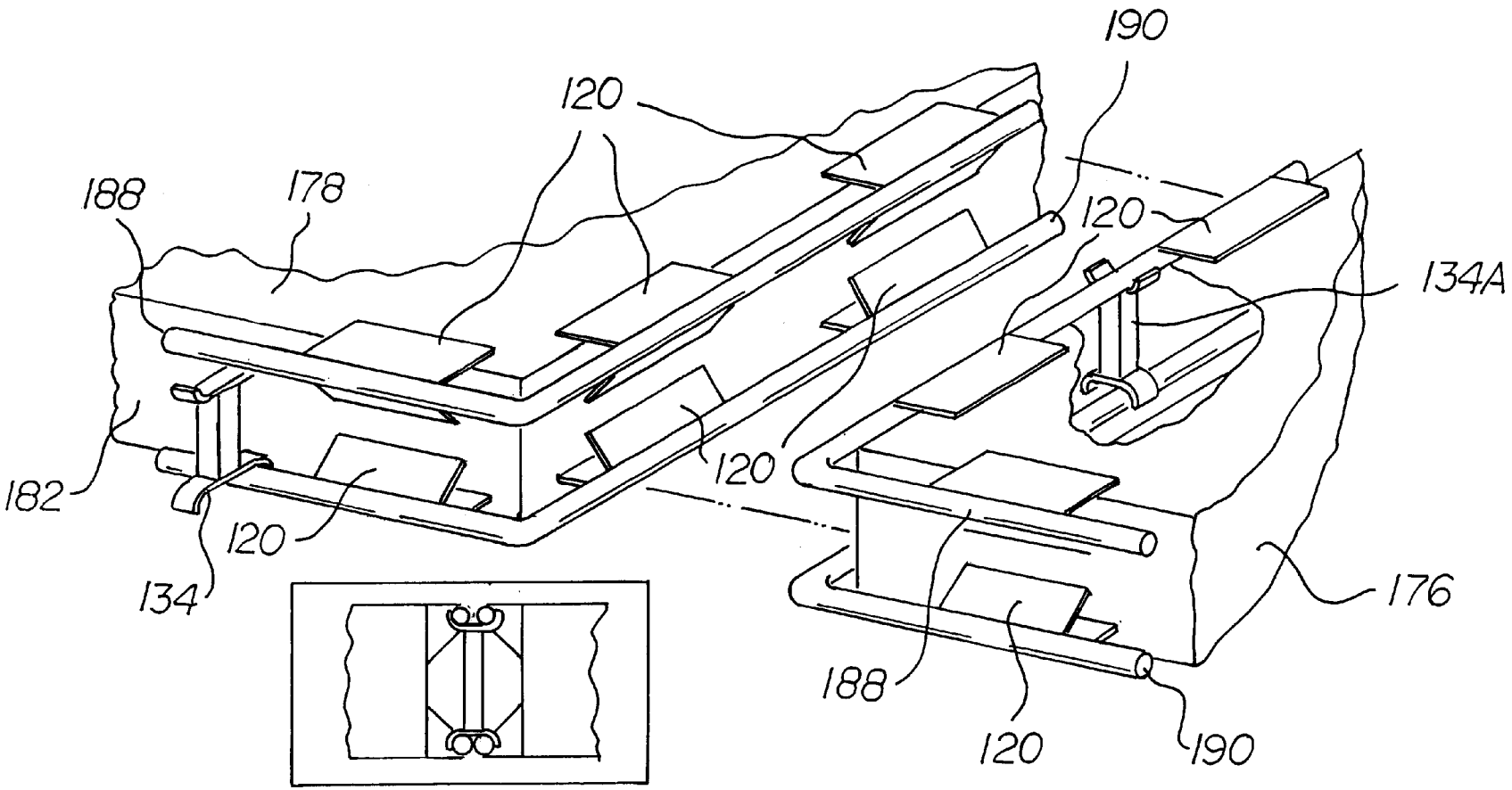
FIG. 8 is a exploded view of an alternative embodiment of the present invention.

Further provided is a plurality of flexible towing links 150 as shown in FIG. 7. Each link has a linear flexible central region 152 as shown in FIG. 7A. Each link has opposed C-shaped ends 150 as shown in FIG. 7G. The first end is adapted to be positioned over a tube of one barge as depicted in FIG. 7D, 151. The second end is adapted to be positioned over a tube of an adjacent barge or towing vessel or dock, etc. 153. A filler member is provided. Aligned apertures 164, FIG. 7C, FIG. 8 are formed in the links for receiving a bolt to secure the links with respect to each other. Although links are readily used to couple barges together, front to back for towing, such links could be used for other coupling purposes such as for coupling to tugs or even to fixed objects while allowing for the raising and for lowering of the tide and/or yawing of vessels due to wave action.

Figures 9, 9A, 9B:
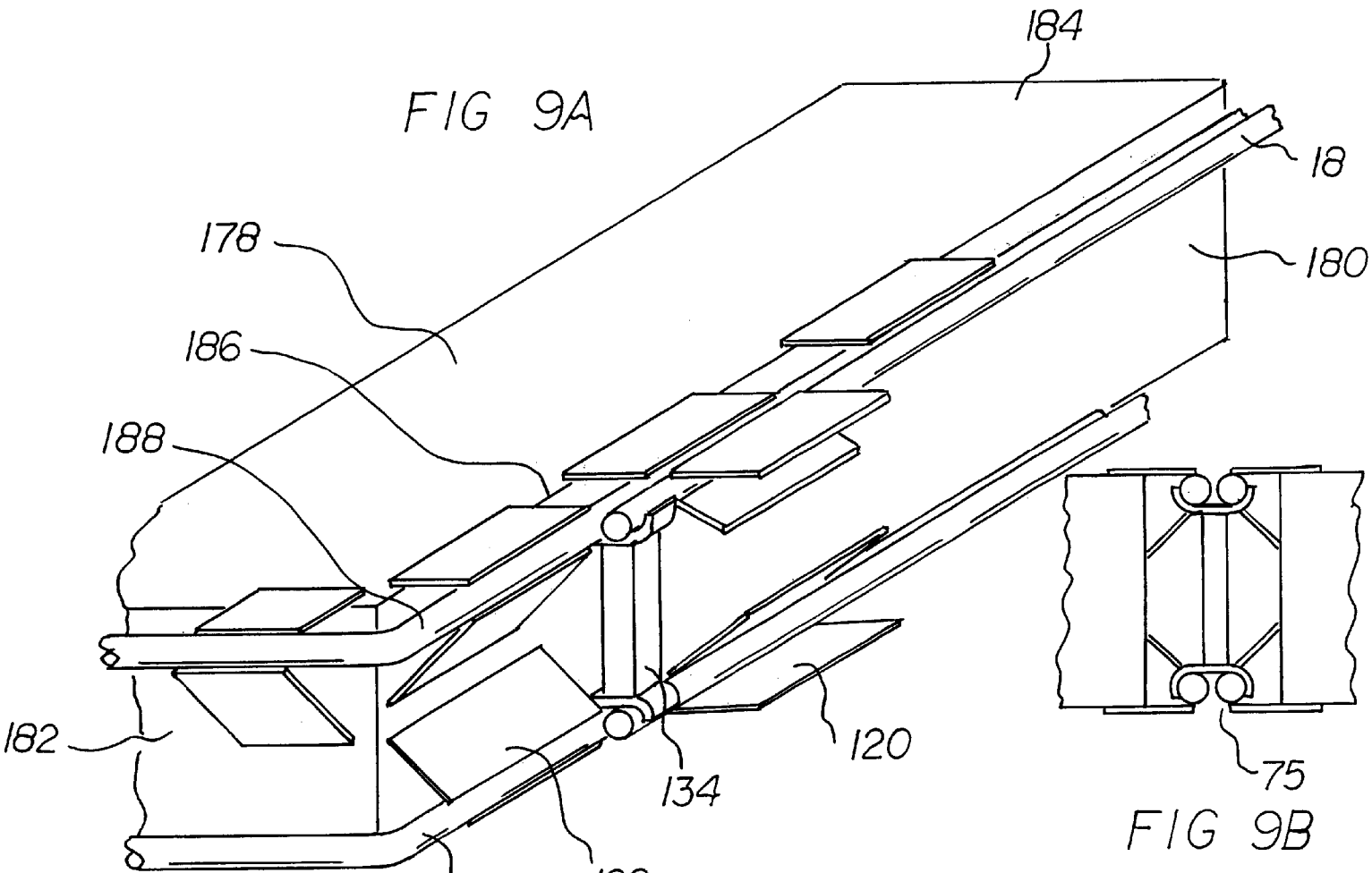
FIG. 9 is a perspective illustration of an alternative embodiment of the present invention.

Even further provided are plates 63 shown in FIGS. 8 and 9. The plates are positioned on the upper plates of adjacent barges. The plates cover the spaces between adjacent recesses.

Provided last is a flexible leveling strap 166. Note FIGS. 6A and 6B. The strap has a first free end 168 and a second fixed end 170 secured adjacent to the upper surface of a barge adjacent to a recess. The strap extends downwardly between a recess 169 and one upper tube 171 and then a lower tube 173. The strap then extends upwardly between an adjacent recess 169 and an adjacent lower tube 175 and then an adjacent upper tube 177. The first free end is adapted to be lifted to raise the adjacent lower ends, and hence the barge, to a common level.

An alternate embodiment of the invention is shown in FIGS. 8 and 9. In such system 172, barges 174 are provided as in the primary embodiment. In the alternate embodiment, the components are configured for the aftermarket, retrofitting old barges rather than for new constructions as in the primary embodiment. Each barge has a horizontal bottom wall 176 and a top wall 178 and vertical side walls 180 and front and rear walls 182, 184. The side walls are devoid of recesses or pockets. Instead, the upper periphery 186 has upper tubes 188 in a rectangular array and lower tubes 190 in a rectangular array, with the tubes spaced from the side walls to allow insertions of the connectors and links which are of the same constructions as in the primary embodiment. Spacer sheets 120 couple the tubes to the plates of the barge.

As a matter of further explanation and clarification, FIG. 1 is a pair of barges with an exploded view of a connector sitting on the top of the drawing on two rails, one each of the bottom rails of each barge, the top rails which would be held in the top view section of the neck of the connector is not shown in this drawing. A pocket 1 shows where the connector 2 would be placed. The connector assembly locks the bottom outside rails 5 and 6 together and are held in place by the U-shaped bottom connector 3. The bottom U and the post could be welded together to make one part. The outer corner railings pass over the pockets, an important part of the invention. They may be made of any product that would create a strong corner that could be used with different shape connectors, or the rails could be different shapes using connectors that would fit them.

FIG. 2 shows a group or cluster or plurality of five barges, all placed together so that they may be connected together as depicted by the arrows. It is necessary to have at least two connectors joining any one barge to any other barge but more may be added for stronger connection if they are required. The pockets in these drawings are enlarged to show the concept more explicitly.

FIG. 3 shows dotted line 7 which is the pocket of right-hand barge in relation to the connector. Dotted line 8 shows the outline of the left-hand barge pocket in relation to the connector. The top rail of the left barge 126 and the bottom rail of the left barge 128 are shown. The top rail of the right-hand barge 127 and number 129 is a bottom rail of the right-hand barge. Number 134 is the connector with post and U-shape connector welded together as one unit. Number 14 is the bottom connector showing the action of putting it in place by lowering and at the same time turning it 90 degrees to cover bottom rails 128 and 129 of two aligned barge pockets. Number 140 is a top portion to connect 126 and 127 being the top rails of two aligned pockets being put in place. Number 140A is number 140 after it has been slid into place under the top rails of 126 and 127. Number 146 is number 140 and 14A again shown in place on top of the bottom connector post 135. Number 19 is an inverted view of the number 140, 140A and 18, showing the skirt number 18 to hold the top and bottom parts of connector aligned with each other. But, a spacer not shown will be placed between the right wall of the pockets 7 and 8 and hold the top connector 140 against the left wall of 7 and 8. This will stop any longitudinal misalignment. Number 148 is a wedge with a cross bar 24 attached to the top side. This wedge when it is driven in between the rails adds rigidness and stability to the connection. Also, the wedge when in place will hold the bottom end of the connector in place, longitudinally along the rails as the wedge 148 will be against the connector post 134 and the other end the cross bar against the pocket wall 7 and 8. Number 22 is an end elevation of 148. Number 23 is a side elevation of 148.

Figure 4:
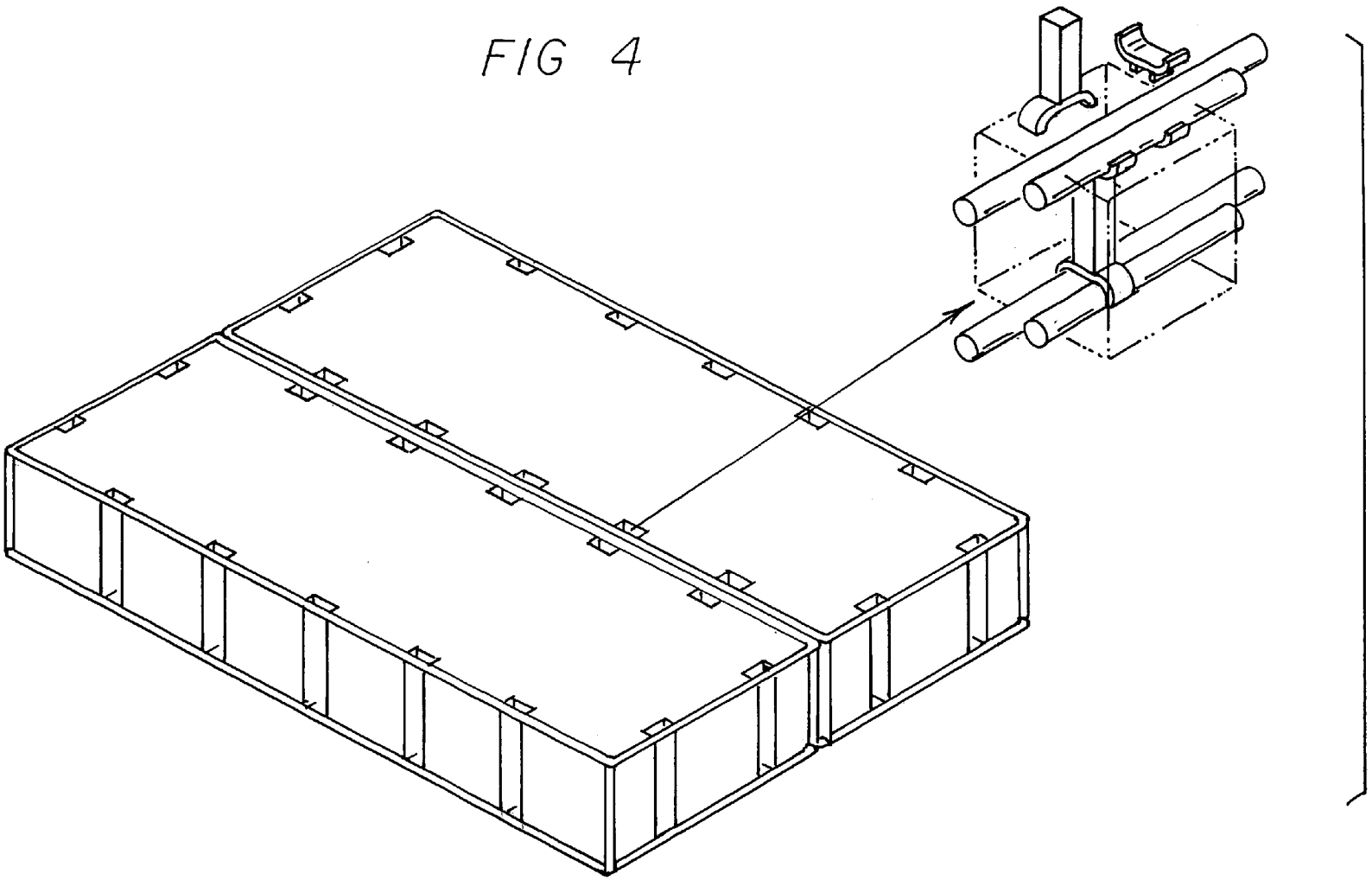
FIG. 4 is an exploded view of the connection system relative to the barges.

FIG. 4 is an exploded view of the connection system.

FIG. 5 is an alternative connector. This connector under many circumstances could be a preferred connector. When in place, the M-shaped bottom connector 20 locks onto opposing barge rails being number 27 and 28, two barges aligned each side of each other. Then at the top you would slide the number 30 into place as with the original connector, then put the wedge in place. The wedge would force the pipes out thus forcing the top connector down the slope on the wedge would be minimal and the slope on the connector 30 a much larger degree. The wedge 33 would be able to fall into place even further by gravity if there was any further slack between the rails. Thus it is a permanent tightening system. That would be allowing gravity to do its work on the wedge if there was ever any movement between the rails. Posts 30 and 29 a predetermined distance between upper and lower connectors 29 and 30.

Number 34 is a wedge made to a width and depth that will hold all parts in place within the pocket, taking up the longitudinal space in the pocket between the connector and the opposite wall of the pocket. This may be placed in spots in both barges besides rails 25 and 26 respectively. Number 35 the isometric view of the wedge showing a retainer late on the top Number 36 is an aerial view of that same thing 37 end elevation.

FIG. 6, a system for leveling barges, so as you can put the connectors in place. This leveling system would be used to level and align barges that are beside each other by using one or two leveling straps. It would probably be advantageous to have one of these at either end when you are trying to connect the barges. There is an anchor and a jacking device. The anchor is the piece that holds the end of the strap. Number 38 is the outline of the pocket of the right-hand barge and number 39 would be the adjacent left-hand barge as far as this drawing is concerned. Number 171 and 173 are the railings of the right-hand barge, 175 and 177 are the railings of the left-hand barge. Number 44, an anchor bar threaded through the eye of a strap, rope, chain, etc. and lying above a pocket with both ends extending past the sides of the pocket on the deck plate of the right barge to stop the strap from pulling through. Number 45 is a strap threaded down through the pocket of the right-hand barge 30, usually the pocket next to the one you are going to be putting the connector in. Under the bottom rail and under the bottom rail of the left hand barge 39 extending out through the pocket of left-hand barge above deck rail may be pulled up or jacked to bring both barges to the same level for placing connectors.

FIG. 7 multi-plate flexible connectors used for towing barges, linking barges together, attaching barges to stationary docks, bridges, etc., as well as towing with any other sort of vessel where you would implement some way of connection to the connectors onto a vessel and then you would tow with the multi plate flexible connectors. The connector may be held in rigid line in one direction and be flexible in other direction, such as two barges hooked together may oscillate, yaw, etc. but still be able to be towed in line. Number 47 is a rail to connect one end of a connector to. This could be a square or round rail or any other shape by making an adapter to fit the shape. These connectors could be made any size, from inches long to many feet long, and to fit any size rail. Number 48 is the rail at the opposite end to number 47. Number 49 is thin plates relative to the width of the connector. Each plate is manufactured to encompass a holding position around the end of the railings 47 and 48 and to have enough play around the rail to prevent binding when twisted in any direction in relationship to the opposite end. That is, if the hole in the end is four inches and you need to twist it a substantial amount you would need about ⅛ inch play there so each connector could lay over that much without binding on the railing. Number 150 is thin plates able to be placed between 47 and 48 after plates 150 are in place. These would be put in there one at a time after the bottom plates are in place. Number 51 a jacket or cover to be put over the connector to maintain stability, capable of taking whatever stress and strain on it by the pulling of the barges, etc. This jacket may be placed over a set of two complete connectors 7C or a set of connectors each end. Half length connectors may be used, the eye portions extending out each end of the jacket putting a retainer bolt through the jacket as well as the half connectors 7D. The jacket may be any length to accommodate for more distance between rails 47, FIG. 7G, and 48, FIG. 7G. When using this configuration the holes 61 which may be extended right through the connectors could be utilized to hold a section of connectors at each end of the jacket or a complete set would be used that would have a short rail 62, FIG. 7E that would fit through the walls of the jacket and extend through both sides as shown by 62, FIG. 7E. FIG. 7A is showing flexibility of connector when one end is held stationary. Number 164, FIGS. 7C and 7B, is a hole for a loose fitting pin to be placed through 49, FIG. 7G, to help during assembly.

Number 61, FIG. 7E, is a row of holes for bolting unit 60 in place in the ends of the jacket 7E or to place the connector into the end of the jacket and slide a bolt right through it to hold half connectors, FIG. 7D, in place.

FIG. 8 is an exploded view of a system for retrofitting existing barges to upgraded connectors or for connecting three barges to others. Number 120, FIG. 8, are plates to be attached to the tops, sides and bottoms or any combination thereof of existing barges. These plates will support the rails 188 and 190, so they may utilize the use of these upgraded connectors. Number 188 are the top rails of barges. Number 134, FIG. 6 is the connector for end connection of barges 134 showing one st of rails only. A connector on the side of the barge is shown utilizing the space between plates.

FIG. 7 shows barge number 178, an existing barge with some modification plates and rails attached. They would be attached all sides around and leaving gaps in between plates to allow placing the connectors. Number 134 is a connector in place. Also placed are number 188 and 190 sections of rails, and 120 adapter plates, parts used for retrofitting existing barges, parts that would allow connection of two barges together, or use them for connecting one or our barges to existing barges. Number 75 is the end view of the components showing how the plates would fit from an end elevation, they are welded to the rails and sides of barge and show the connector 134 in front of the plates 120.

Figures 10, 10A, 10B, 10C:
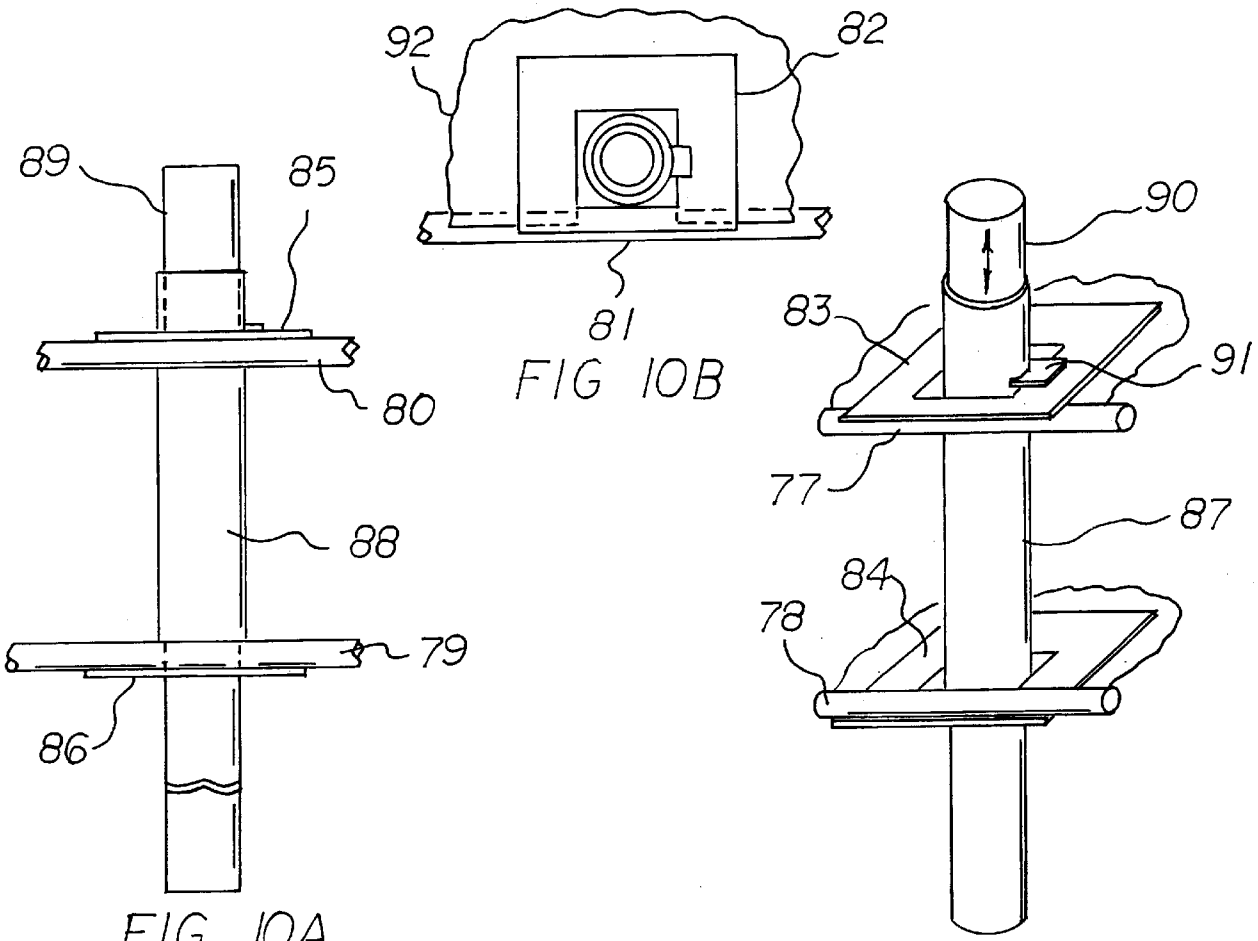
FIGS. 10A, 10B and 10C are a perspective illustrations of a stud assembly w the present invention.

FIG. 10 shows the drawing on the left hand side shows a stud within a stud well which is attached to the barge. Number 80 and 79, FIG. 10A being the top and bottom rails of the barge, 85 and 86, FIG. 10A, being the heavy plates that are welded onto the top and bottom of the barge. Number 88 is the outer tube of the stud well. This could be round, rectangular or square. The spud well floats up and down with the barge on 89, FIG. 10A, which is a spud which is dropped down through 88 until it hits bottom and then it becomes an anchor for the barge. Number 82 is shown on FIG. 10B as an aerial view. Number 81 shows the rail of the barge. The breakaway drawing 92 is showing a portion of the deck of the barge. The isometric drawing on the right-hand side, FIG. 10D, shows 78 and 77 being the bottom and top rails respectively. Number 84 is the bottom plate which would run underneath the barge so as it would give the same strength as the one on the top. Number 87 is the spud well, 90 is the spud itself. Number 91 is a means of stopping the spud well from going up and down without the barge. The complete system is manufactured so the barge is reversible top for bottom when the barge is turning over you would pull 87 and 90 out and place it in from what would then become the top.

FIG. 11 shows alternatives.

FIG. 11A shows some rails being the edges of two barges. They could be square, rectangular or just a heavily built corner on the barge, two side plates could be bolted through to make a connection. FIG. 11B is a system with four parts, the two center pieces of the four pieces could be permanently attached to the barge and then plates bolted on top and bottom. FIG. 11C is a system showing a tie bolt through connectors between two barge railings. FIG. 11D is a square block in between top and bottom rails of two barges with a rope, chain or strap retainer. FIG. 11E is a clamping connector usable as drawn or horizontal to connect barges together. FIG. 11F is a concept with the C hooks being attached to the pipes and bolted together either vertical as shown or horizontal. FIG. 11G is a simple clamp that could be utilized on top rails or top and bottom.

Figures 12, 12A, 12B, 12C:
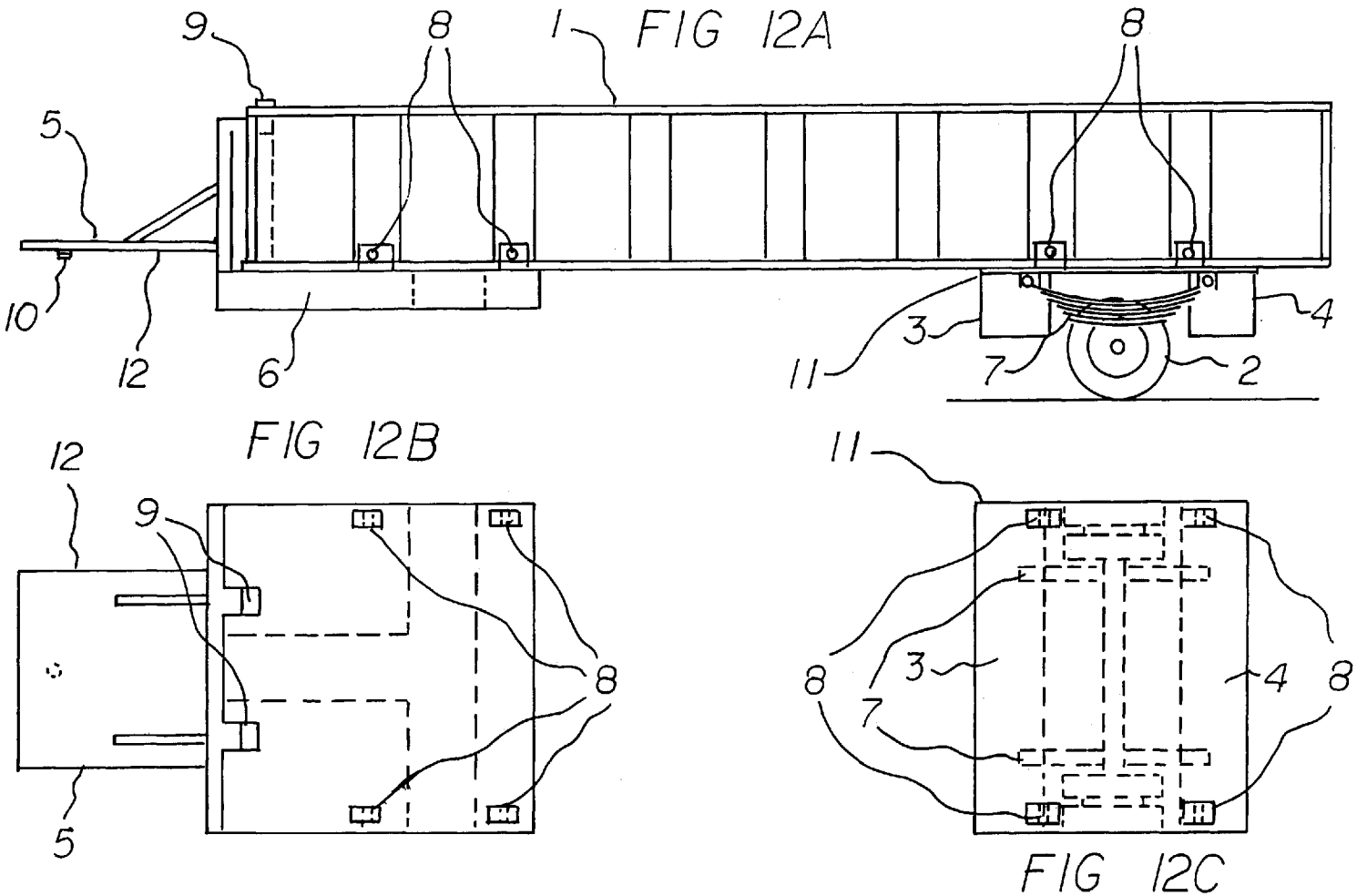
FIGS. 12A, 12B and 12C are perspective illustrations of an alternative embodiment of the present invention adapted to be transported.

FIG. 12 barges are self-supporting for towing such as including a towing system at the rear of the barge that would fit into the pockets with adapters. On the front is a pocket adapted tow bar. This figure shows the towing system utilizing pocket and rail. A, B and C are all interconnected with numbers:

1—a barge fitted with road transport devices;

2—a set of wheels to transport barge;

2 & 4—air tanks with air tight compartments to be balanced when attaching or detaching rear device to the barge when it is floating;

5—a means of towing barge

6—air tank with comparts to float towing device under the barge when barge is in water 7—a set of springs attaching the axle of towing device to No. 11

8—connectors for attaching transport devices fitting up through pockets of barge and then pinned 9—attaching hook fitting up through top of barge end pockets 10—a means of towing 11—a mounting plate to facilitate attaching components of rear towing system;

12—a plate to extent forward to allow attaching towing device to a tow vehicle

Note should be taken that air tanks could be pressurized, and or deflated, or partly filled with liquid to make them submersible and balanced to the best degree for attaching to the barge.

Figures 13, 13A, 13B, 13C:
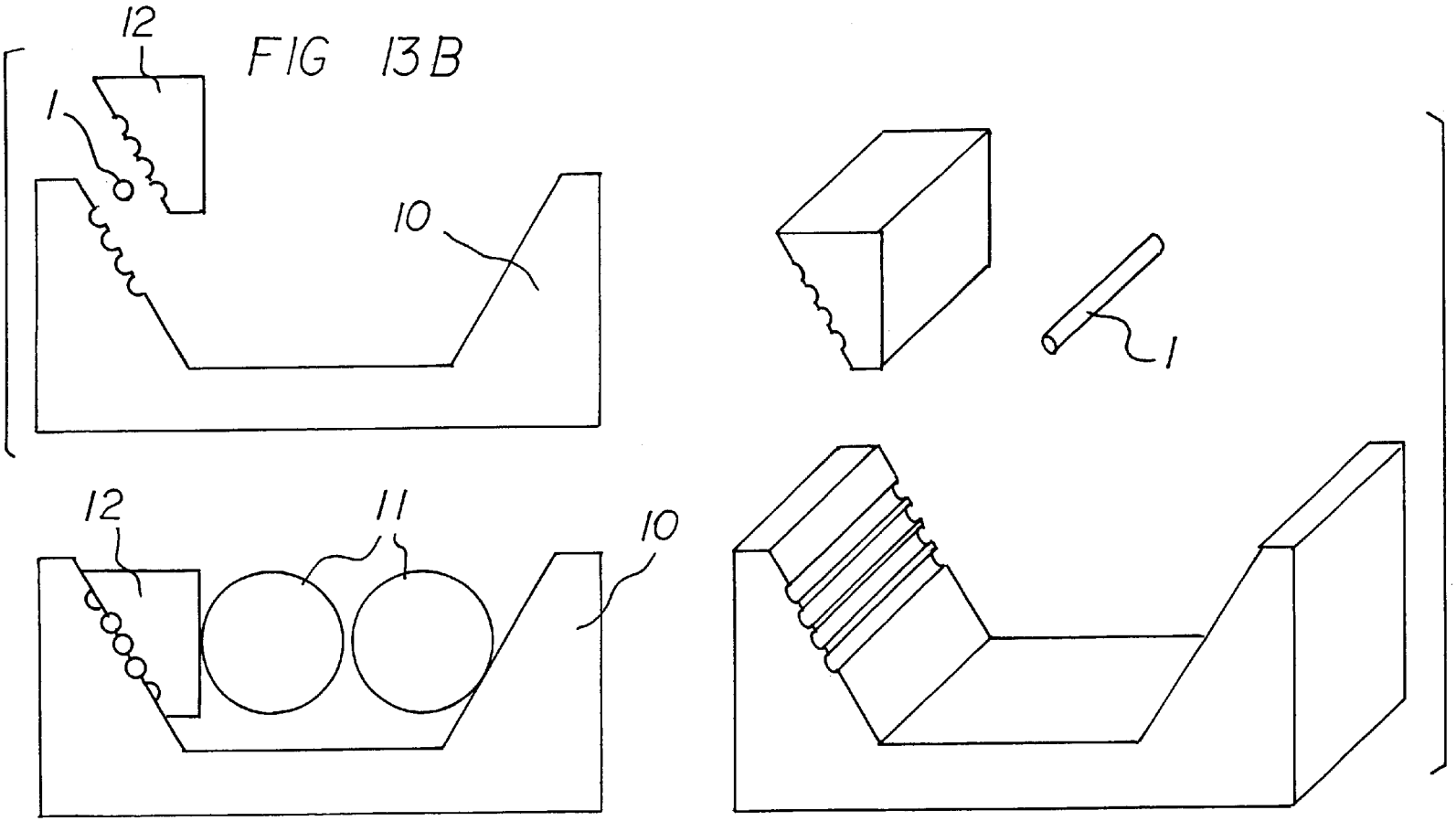
FIG. 13A is an elevational view of an upper connector with two tubes connected.
FIG. 13B is an elevational view of an upper body connector prior to assembly with the wedge and retainer pin.
FIG. 13C is a isometric view of the parts for the upper connector unit.

FIG. 13 shows an alternative top section of a connector to utilize with any other bottom portion of a connector. This top section allows predetermination of the tightness of coupling barges together by adjusting the wedge position and then inserting the round pin in the appropriate matching flutes. It may also be used to draw the last short distance together of barges being connected together.

FIG. 13A shows an upper connector today 10 shown with two tubes 11 to be connected. A wedge 12 forces the tubes tightly against each other and the sloping side of the body 10. This will also force the body down against the post of the lower connector body allowing control of desired vertical play in the whole connector. FIG. 13B shows the upper body connector 10 prior to assembly with the wedge 12 and retainer pin 13. FIG. 13C shows an isometric view of the parts for upper connector unit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A barge system for safely, securely and conveniently coupling together a plurality of barges comprising, in combination:

a plurality of barges, each barge being in a rectilinear configuration with a horizontal rectangular upper plate and a parallel lower plate, the horizontal plates having long parallel side edges and short parallel front and rear edges, each barge also having a pair of vertical parallel side plates and vertical parallel front and rear plates with the vertical plates having upper edges interconnected by a rail or tube to the edges of the upper plate to define an upper periphery of rails or tubes and with the vertical plates having lower edges interconnected by rail or tube to the edges of the lower plate to define a lower periphery;

a plurality of vertically disposed recesses formed in the vertical plates and the upper and lower plates, the recesses constituting pockets inwardly of the tubes, the recesses all having a common height equal to the height of the barge and a common axial length and a common lateral width;

a plurality of connectors, each connector including a rectilinear vertical post positionable in adjacent recesses of adjacent barges to be coupled between upper and lower tubes, each connector having an upper end and a lower end with the lower end having a downwardly facing inverted U-shaped member with a first arcuate portion positioned upon a lower tube of one barge and a laterally disposed second arcuate portion positioned upon an adjacent lower tube of an adjacent barge for coupling the barges, an upwardly facing uninverted U-shaped member with a first arcuate portion positioned to receive an upper tube of one barge and a laterally disposed second arcuate portion positioned to receive an adjacent upper tube of an adjacent barge for coupling the barges, the uninverted U-shaped member having a depending three sided skirt adapted to be slid over the upper extent of the vertical post during the coupling of barges;

a wedge positioned within a recess between adjacent upper and lower tubes with the wedge in contact with one end of the connector to thereby preclude axial displacement of the connector along the tubes;

a plurality of towing links, each link having a linear central region and opposed C-shaped ends, a first end adapted to be positioned over a tube of one barge in a recess and a second end adapted to be positioned over a tube of an adjacent barge in an adjacent recess of an adjacent barge for coupling the front of one barge to the back of another barge to be towed and with a filler member positioned in each link between the ends to fill the space between the ends of the links and with supplemental wedges in the recesses receiving the links to preclude axial shifting of the links during towing;

plates positioned on the upper plates of adjacent barges to cover the spaces between adjacent recesses; and a flexible leveling strap having a first free end and a second fixed end secured adjacent to the upper surface of a barge adjacent to a recess with the strap extending downwardly between a recess and one upper tube and then a lower tube and then upwardly between an adjacent recess and an adjacent lower tube and then an adjacent upper tube, the first free end adapted to be lifted to raise the adjacent lower ends, and hence the barge, to a common level.

2. A barge system comprising:

a barge in a rectilinear configuration with upper and lower plates and a pair of side plates and front and rear plates to define an upper periphery and a lower periphery;

tubes around the upper and lower peripheries;

at least one connector for coupling more than one barge together, the connector coupling adjacent barges between upper and lower tubes, each connector having an upper end and a lower end with the lower end having a downwardly facing inverted U-shaped member; and a plurality of recess about the side plates of the barge system, the recesses having an associated tube there adjacent.

3. The system as set forth in claim 2 and further including:

a plurality of vertically disposed recesses formed in the side, front and rear plates.

4. The system as set forth in claim 2 and further including:

a plurality of connectors, each connector including a post positionable in adjacent recesses of adjacent barges to be coupled, each connector having an upper end and a lower end with the lower end having a downwardly facing inverted U-shaped member with a first portion positioned upon a lower tube of one barge and a laterally disposed second portion positioned upon an adjacent lower tube of an adjacent barge, an upwardly facing U-shaped member with a first portion positioned to receive an upper tube of one barge and a laterally disposed second portion positioned to receive an adjacent upper tube of an adjacent barge.

5. The system as set forth in claim 2 wherein the tubes are coupled directly to the plates of the barge.

6. The system as set forth in claim 2 wherein the tubes are coupled spaced from the plates of the barge with spacer sheets coupling the tubes and the plates.

7. The system as set forth in claim 4 and further including:

a wedge positioned between the upper and lower tubes with the wedge in contact with one end of the connector to thereby preclude axial displacement of the connector along the tubes.

8. The system as set forth in claim 2 and further including:

a plurality of towing links, each link having a linear central region and opposed C-shaped ends, a first end adapted to be positioned over a tube of one barge and a second end adapted to be positioned over a tube of an adjacent for coupling the front of one barge to the back of another barge to be towed.

9. The system as set forth in claim 2 and further including:

a means to transport the system on land.

10. The system as set forth in claim 9 wherein the transport system includes a plurality of wheels with shock absorbing means and a vehicle coupling means.

11. The system as set forth in claim 10 wherein the transport means being adapted to be coupled to the pockets of the barge and pinned in place.

12. The system as set forth in claim 2 further including a transport means and a tank with a plurality of air tight compartments throughout the system, the air tight compartments providing stability when in the water to allow stable transport.

13. The system as set forth in claim 2 and further include a mean to tow the barge in the water.

14. The system as set forth in claim 2 and further including a means to tow from the rear of the barge.

* * * * *